US006340241B2

(12) United States Patent
Jeanneret

(10) Patent No.: US 6,340,241 B2
(45) Date of Patent: Jan. 22, 2002

(54) POWER RESERVE INDICATOR MECHANISM AND WATCH FITTED WITH SUCH A MECHANISM

(75) Inventor: Sébastien Jeanneret, Le Locle (CH)

(73) Assignee: Parmigiani, Mesure et art du Temps S.A. (CH)

( * ) Notice: Subject to any disclaimer, the term of this patent is extended or adjusted under 35 U.S.C. 154(b) by 0 days.

(21) Appl. No.: 09/817,453

(22) Filed: Mar. 26, 2001

(30) Foreign Application Priority Data

Mar. 27, 2000 (EP) ..... 00106573

(51) Int. Cl.[7] ..... G04B 9/00
(52) U.S. Cl. ..... 368/210; 368/66
(58) Field of Search ..... 368/210, 66

(56) References Cited

U.S. PATENT DOCUMENTS 2,698,066 A * 12/1954 Favret ..... 368/126
6,166,999 A * 12/2000 Jujo et al. ..... 638/66

* cited by examiner

*Primary Examiner*—Bernard Roskoski
(74) *Attorney, Agent, or Firm*—McGlew and Tuttle, P.C.

(57) ABSTRACT

Power reserve indicator mechanism for a timepiece movement of the type provided with a power source formed of a motor spring (26), including a frame (10, 12, 14, 16), a power reserve indicator and a differential gear (30) with a first input (44) connected to a wheel (29) driven in rotation when the motor spring is wound, a second input (42) connected to a wheel (20) driven in rotation when the motor spring is let down, and an output **(36*a*) connected to said indicator, wherein the indicator is capable of covering a given angle comprised between two end positions, defined by a stop (78)**.

According to the invention, an intermediate wheel (32) is inserted between the output of the differential gear and said indicator and includes a resilient member (64) arranged so that the differential gear rotates freely while the indicator remains in abutment.

15 Claims, 4 Drawing Sheets

POWER RESERVE INDICATOR MECHANISM AND WATCH FITTED WITH SUCH A MECHANISM

FIELD OF THE INVENTION

The present invention concerns power reserve indicator mechanisms for movements for timepieces of the type fitted with a power source formed of a motor spring. In a conventional manner, the mechanism according to the invention includes a frame, a power reserve indicator and a differential gear with a first input connected to a wheel driven in rotation when the motor spring is wound, a second input connected to a wheel driven in rotation when the motor spring is let down, and an output connected to the power reserve indicator. In this mechanism, the indicator is capable of covering a given angle comprised between two end positions, the first of which is occupied when the motor spring is wound and the second, defined by a stop, when the motor spring is let down.

BACKGROUND OF THE INVENTION

A mechanism of this type is described in <<La montre suisse à remontage automatique>> by B. Humbert, Scriptar edition, Lausanne 1955, at page 85. It is provided with an indicator which is friction fitted onto a wheel connected to the output of the differential gear. The indicator moves between two end positions defined by stops. When the indicator reaches one of the stops, of the upper winding or letting down limit of the motor spring, it remains stationary while the motor spring continues to be wound or let down, the friction allowing the gear train to move while the indicator is stationary.

Such a solution thus provides an idea as to the real winding of the motor spring, but there may be significant differences from one cycle to another, due to the relative movement of the indicator with respect to the gear train. The object of the present invention is to overcome this drawback.

SUMMARY OF THE INVENTION

The mechanism according to the invention is thus characterized in that an intermediate wheel is inserted between the output of the differential gear and the indicator and includes a resilient member and two coaxial parts, one formed of a wheel, and the other of an arbor, one connected to the differential gear, the other to the indicator and connected to each other by the resilient member, the wheel being arranged so that the two parts rotate together while the indicator occupies a position comprised between the two end positions and in that, at least when the indicator occupies its second end position, the differential gear continues to rotate freely while the indicator remains in abutment and the resilient member is wound, while the motor spring drives the movement.

Advantageously, it is the wheel inserted between the differential gear and the indicator which meshes with the output of the differential gear.

In a particularly advantageous embodiment, the first resilient member includes a cam, secured in rotation to the arbor of the intermediate wheel, and a spring which can deform radially and is rigidly secured by one of its ends to the wheel of the intermediate wheel. This cam cooperates with the free end of the spring. The assembly is arranged such that the free end of the spring slides over the cam when the indicator is in abutment and the motor spring continues to be let down and generate an opposite torque to that exerted by the motor spring.

Consequently, each position of the indictor corresponds to a winding level of the motor spring. Moreover, the timepiece can continue to operate when the indicator has reached the lower limit. The user is, however, informed that the precision of his watch is liable to have been affected by insufficient driving torque, causing a loss of amplitude of the balance.

It is evident that such a mechanism has to include a set of gears to be able to operate normally. This set of gears affects the precision of the displayed information. Also, in order to further improve the agreement between the position of the indicator and the winding of the motor spring, the mechanism according to the invention advantageously includes a second resilient member arranged to exert a permanent torque on the gear train comprised between the two inputs of the differential gear and the intermediate wheel.

In a particularly reliable embodiment, the second resilient member includes an arbor rigidly secured to the frame, a drum provided, at its periphery, with a toothing which meshes with the part of the wheel connected to the indicator, and a strip spring arranged in the drum and secured, by one of its ends, to the arbor of the second resilient member and, by the other, to the drum.

Depending on the way in which the second resilient member works, fluctuations of more or less significance in the amplitude of the balance may result. Indeed, if the motor spring has to wind the second resilient member progressively as it is itself let down, the useful torque decreases to the same extent. The winding torque increases progressively as the motor spring is let down. This is why, in order to assure optimum amplitude of the balance, the second resilient member is arranged such that it is wound and let down simultaneously with the motor spring.

Such a mechanism is particularly well suited to fit a watch including a motor spring assuring a power reserve of 8 days.

BRIEF DESCRIPTION OF THE DRAWING

Other features and advantages of the invention will appear from the following description, made with reference to the annexed drawing, in which.

DESCRIPTION OF A PREFERRED EMBODIMENT

Figure 3:
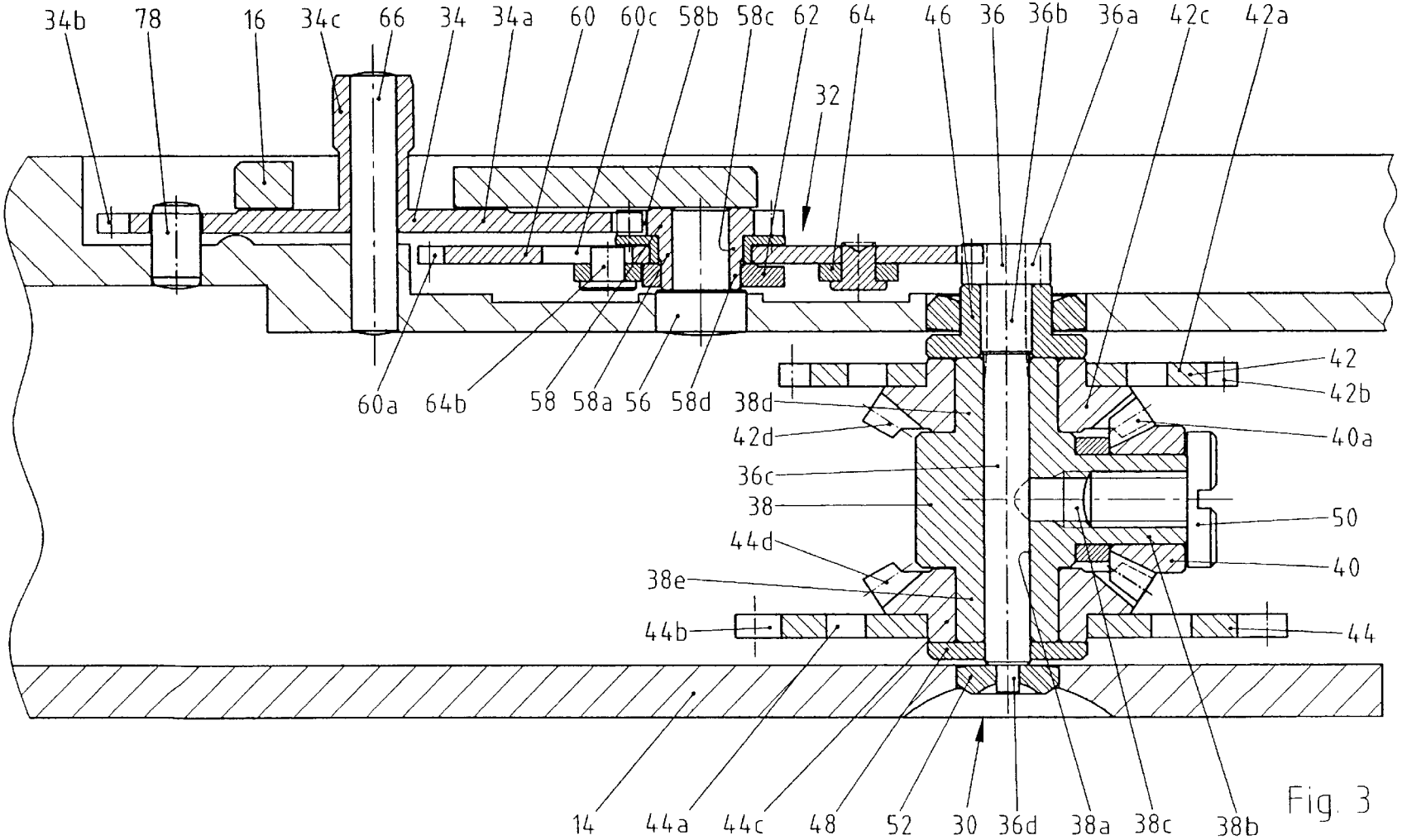
Figure 4:
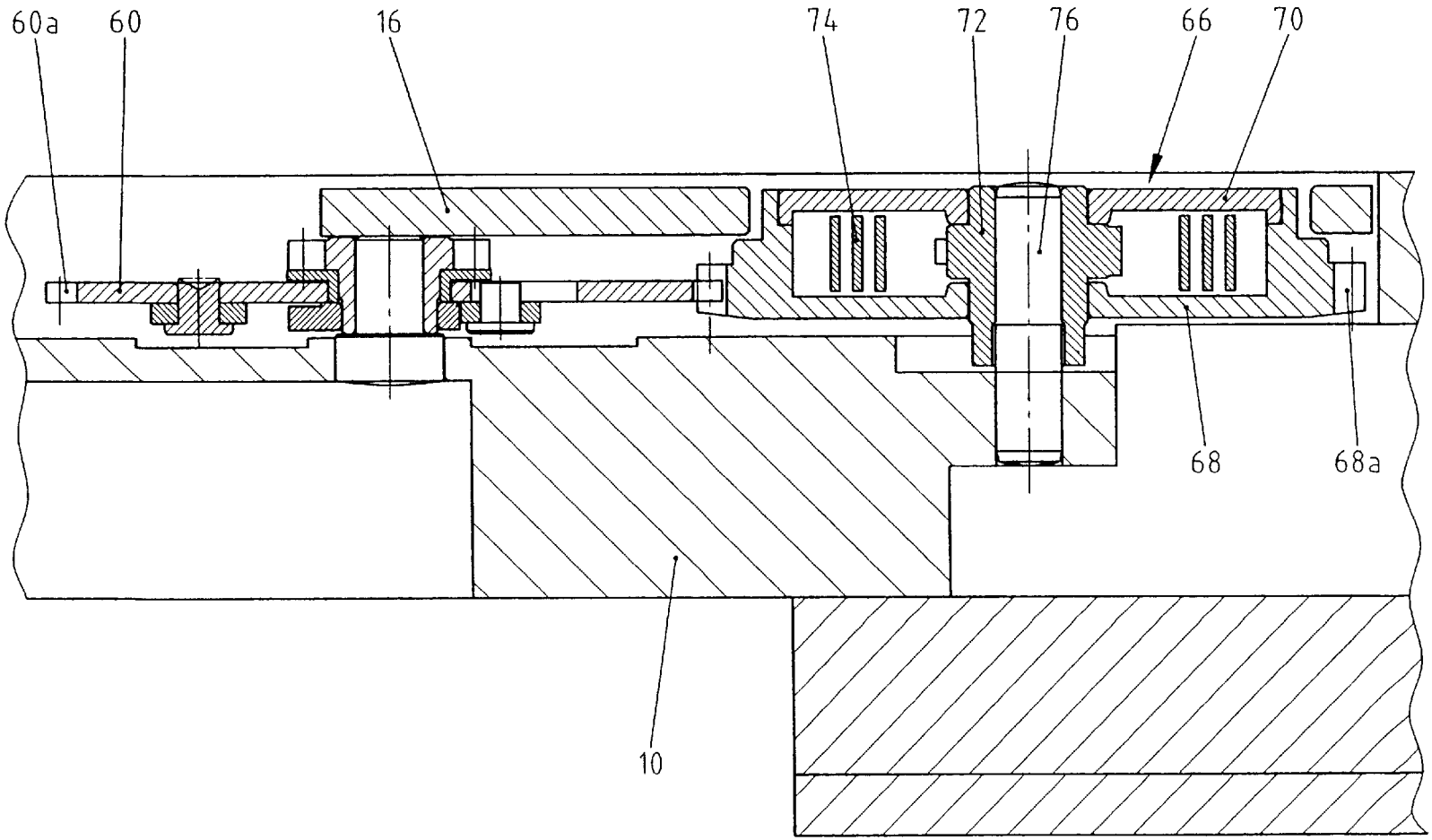

The mechanism according to the invention is associated with a watch movement such as partially shown in the drawing. This movement includes, in a conventional manner, a frame formed of a bottom-plate 10 and several bars secured to this plate 10, three of which are visible in the drawing, namely a barrel bar 12 (FIG. 2), a differential bar 14 (FIGS. 2 and 3) and a power reserve indicator bar 16 (FIGS. 3 and 4). The bottom-plate and the bars are intended to support and position the different moving components of the movement.

Figure 2:
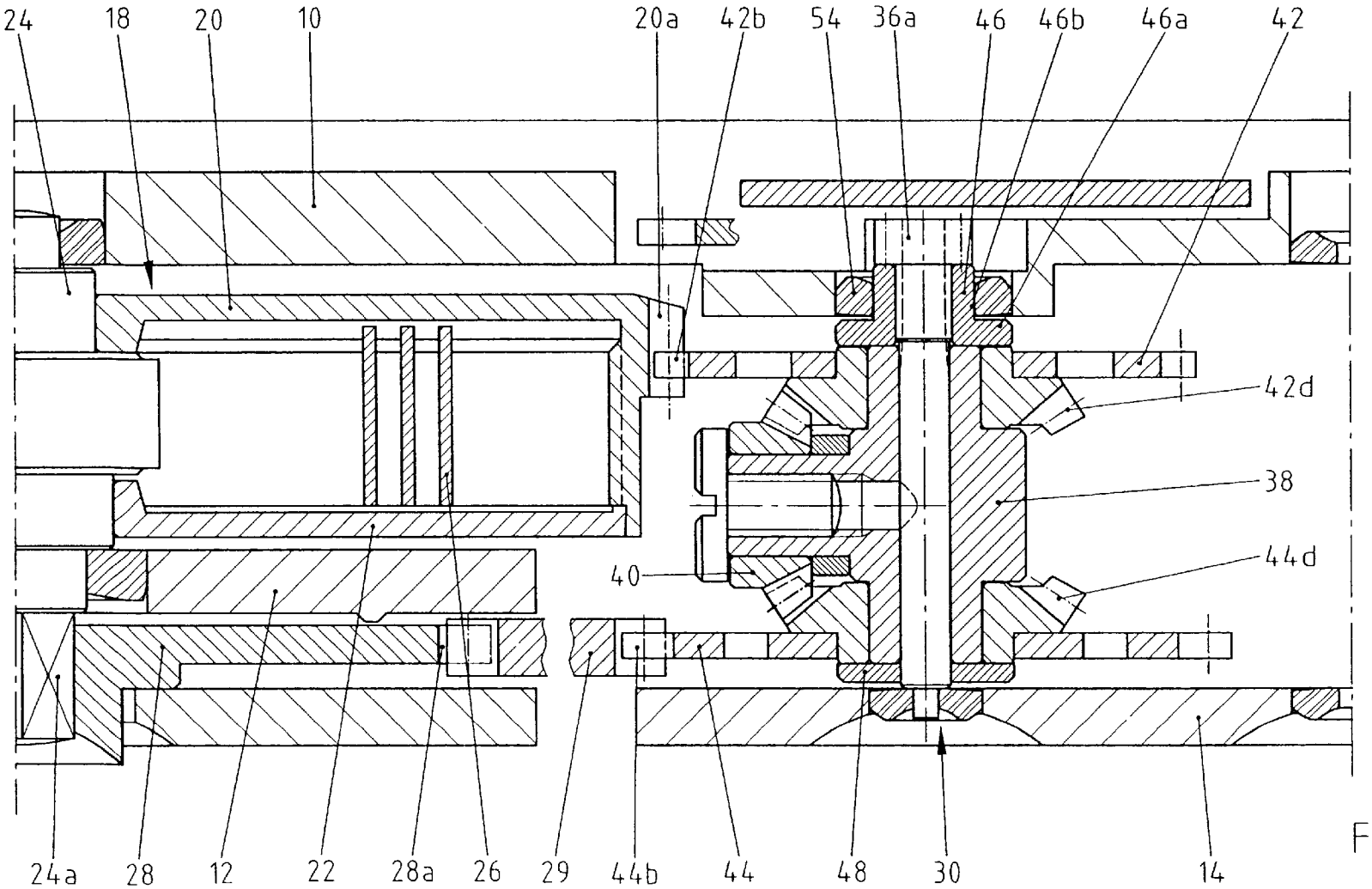
FIGS. 2, 3 and 4 are cross-sections respectively along the lines II—II, III—III and IV—IV of FIG. 1.

As can be seen in FIG. 2, this movement includes a power source formed of a barrel 18, which includes a drum 20, a cover 22, an arbor 24 and a motor spring schematically shown at 26. Motor spring 26 is disposed inside the drum and secured, in a conventional manner, to the wall of the drum by one of its ends and to the arbor by the other. Drum 20 is closed by the cover 22 which is snap fitted into a groove of the drum, which is not referenced to avoid overloading the drawing.

Drum 20 and cover 22 together form an assembly mounted so as to move in rotation on arbor 24.

Arbor 24 pivots, on the one hand, in bottom-plate 10, and on the other hand in barrel bar 12. It carries, on a square portion 24*a* beyond bar 12, a ratchet-wheel 28, provided, at its periphery, with a toothing 28*a*. The driving of arbor 24 in rotation, by means of a winding crown, which has not been shown, assures the winding of motor spring 26.

Drum 20 is provided, at its periphery, with a toothing 20*a* intended to drive the gear train which has also not been shown in the drawing.

The mechanism according to the invention includes a setting wheel 29, a differential gear 30 mounted so as to pivot between bottom-plate 10 and differential bar 14, an intermediate wheel 32 and an indicator wheel 34 (FIG. 3).

More precisely, differential gear 30 includes an arbor 36, a planetary wheel carrier 38 on which are mounted a planetary wheel 40, a first input wheel 42 and a second input wheel 44, two assembling rings 46 and 48 and a screw 50.

Arbor 36 is formed of a steel stem one end of which has a toothing forming a pinion 36*a*. It includes two intermediate portions 36*b* and 36*c*, and a pivot 36*d* occupying the other end and engaged so as to move in rotation in a jewel 52 driven into bar 14. It can rotate about an axis perpendicular to the plane of bottom-plate 10.

Planetary wheel carrier 38 is formed of a metal part provided with a central cylindrical hole 38*a*. It is driven onto arbor 36, which is engaged via its portion 36*c* in hole 38*a*. It includes, in its median part, a cylindrical protuberance 38*b* extending radially and provided with a threaded hole 38*c* intended to accommodate screw 50. It further includes two cylindrical portions 38*d* and 38*e* which are coaxial to hole 38*a*.

Protuberance 38*b* carries planetary wheel 40 which can rotate freely about an axis perpendicular to the rotational axis of arbor 36. This planetary wheel 40 is provided with a conical toothing 40*a* the function of which will be specified hereinafter.

The two cylindrical portions 38*d* and 38*e* carry, respectively, wheels 42 and 44, adjusted so as to be able to rotate freely therein. These wheels are disposed between protuberance 38*b* and respectively rings 46 and 48.

Wheels 42 and 44 are each formed by a plate, identified by the letter a and the periphery of which carries a toothing b, and a pinion c provided with a conical toothing d. Wheel 42 meshes, via its toothing 42*b*, with the toothing of barrel 20*a*. Wheel 44 meshes, via its toothing 44*b*, with setting wheel 29, which meshes with toothing 28*a* of ratchet wheel 28 (FIG. 2). Finally, toothings 42*d* of pinion 42*c* and 44*d* of pinion 44*c* are meshed with toothing 40*a* of planetary wheel 40 (FIG. 3).

It is to be noted that the gearing ratios between toothing 20*a* of the barrel drum and first input wheel 42, on the one hand, and that of ratchet wheel 28 and second input wheel 44, on the other hand, must be equal, so that, for a same angle covered by the barrel and the ratchet wheel, wheels 42 and 44 cover equal angles.

Ring 46 is formed of a flange 46*a* and a sleeve 46*b*. It is engaged on portion 36*b* of arbor 36 and abuts against pinion 36*a* via the end of sleeve 46*b*. This latter is engaged, via its outer surface, in a jewel 54 driven into bottom-plate 10. Flange 46*a* forms a stop for planetary wheel carrier 38.

Ring 48, formed of a round plate pierced at its center, is forcibly driven onto the end of portion 36*c* of arbor 36. With ring 46, it assures the assembly of the set of parts forming differential gear 30.

Intermediate wheel 32 is mounted so as to pivot on bottom-plate 10 by means of a pivot-shank 56. It essentially includes a pinion 58, a wheel 60, a cam 62 and a connecting spring 64.

More precisely, pinion 58 includes a sleeve 58*a* mounted so as to pivot on pivot-shank 56. It is provided, at one of its ends, with a toothing 58*b*. Sleeve 58*a* is formed of two cylindrical portions 58*c* and 58*d*, of different external diameters.

Figure 1:
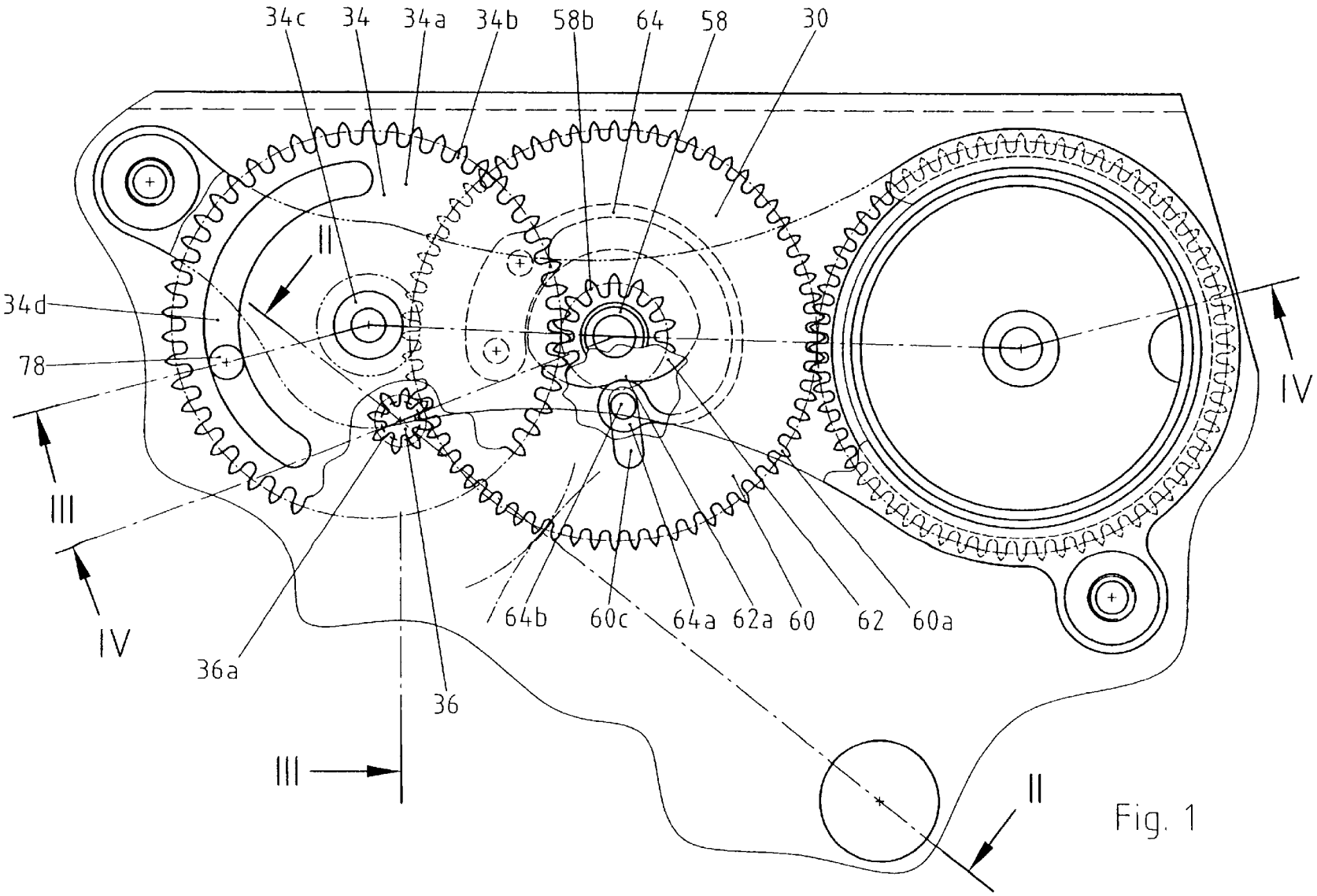
FIG. 1 shows a plan of a mechanism according to the invention.

As can be seen more particularly in FIG. 1, wheel 60 is formed of a plate the periphery of which is provided with a toothing 60*a* which meshes with toothing 36*a* of pinion 36. It is mounted so as to rotate freely on portion 58*c*. The plate is provided with an oblong hole of radial orientation 60*c* the function of which will be specified hereinafter.

Cam 62 has a shape close to that of a chronograph heart piece, with a concave portion 62*a* and two contiguous raised portions which have not been referenced. It is driven onto cylindrical portion 58*d* and holds wheel 60 axially.

Spring 64 is formed of a resilient strip in the shape of an arc of a circle spanning an angle of approximately 270°. It is secured, by one of its ends and in a known manner to the plate of wheel 60. The other end forms a protuberance 64*a* disposed such that it abuts against cam 62, in its concave portion 62*a*. A finger 64*b*, disposed in the median portion of protuberance 64*a*, is engaged in hole 60*c*.

Indicator wheel 34 is mounted so as to pivot on a pin 66 driven into bottom-plate 10. It includes a plate 34*a* provided, at its periphery, with a toothing 34*b* meshed with toothing 58*b* of pinion 58, and a pipe 34*c* extending beyond the bottom-plate and intended to carry a power reserve indicator hand, which is not shown in the drawing.

Plate 34*a* includes a cut out portion 34*d* in the shape of an annular sector spanning an angle of approximately 150°. A pin 78, driven into bottom-plate 10, is engaged in cut out portion 34*d* and acts as a stop for wheel 34.

In a watch movement fitted with a mechanism as described hereinbefore, the motor spring 26, when being let down, drives in rotation and in a conventional manner barrel drum 20 whose toothing 20*a* meshes with the first wheel of the gear train. This latter is connected to an escapement, which maintains the movement of a sprung balance.

If drum 20 rotates during the letting down of motor spring 26, arbor 24 is, conversely, stationary. Wheel 42 of differential gear 30 is thus driven in rotation, while wheel 44 remains still. Pinion 42*c*, which rotates with wheel 42, meshes with planetary wheel 40.

Since wheel 44, and with it pinion 44*c*, is stationary, planetary wheel 40 can only rotate by driving planetary wheel carrier 38. This latter, which carries pinion 36*a*, causes intermediate wheel 32 to rotate, which in turn drives indicator wheel 34.

Thus, progressively as motor spring 26 is let down, indicator wheel 34 moves facing a scale disposed on the watch dial, until it reaches the lower normal operating limit. Below this limit, the movement can still function for a certain time. However, its precision is liable to decrease, because of the loss of amplitude of the balance. The power reserve indicator thus indicates that it has run down and indicator wheel 34 is immobilized, the end of cut out portion 34*d* abutting against pin 78.

If the user of the watch still does not wind up motor spring 26, the latter continues to be let down causing the watch movement to operate. Differential gear 30 thus continues to rotate and, with it, wheel 60. Since pinion 58 meshes with indicator wheel 34, it is blocked. Wheel 60 thus has a relative movement with respect to pinion 58. This movement is made possible because wheel 60 is connected to pinion 58 by connecting spring 64, which is driven by wheel 60. Protuberance 64*a* slides on cam 62 of concave portion 62*a* towards one of the raised portions. The deformation of spring 64 occurs only radially, because of finger 64*b* engaged in hole 60*c*. The letting down of motor spring 26 can occur until the torque applied to the balance is insufficient to drive its movement, so that the watch stops.

When the user of the watch winds motor spring 26 by turning the winding crown, he drives ratchet wheel 28 and, via setting wheel 29, input wheel 44. This latter causes planetary wheel carrier 38 to rotate in the opposite direction to that which is generated by the movement of drum 20. As a result, pinion 36*a* causes wheel 60 to rotate such that protuberance 64*a* slides, in the opposite direction, on cam 62 until it returns to concave portion 62*a*. It is then that pinion 58 is again driven and, with it, indicator wheel 34, so that the indicator moves facing the scale on the dial. This indicator reaches the upper end of the scale when motor spring 26 is completely wound.

In practice, it is difficult to make the maximum winding position of the motor spring coincide exactly with the end position of the indicator corresponding to the largest power reserve. This is why, in this position too, the indicator wheel can be stopped by pin 78. Here too, spring 64 is involved, protuberance 64*a* sliding on the other flank of cam 62.

The mechanism described relies on a gear train whose wheels must have, between them, sufficient circumferential play to avoid any jamming during operation. Because of this circumferential play, the position of the indicator does not correspond to the same degree of winding of the motor spring, depending on whether the latter is in the process of being wound or let down. As a result, at the beginning of the winding operation by the user, the latter only sees the indicator move after the set of gears has meshed, which gives him the impression that the mechanism is not operating as it should. The device shown in FIG. 4 allows this fault to be removed.

More precisely, the mechanism according to the invention includes, advantageously, a complementary resilient member 66 intended to generate a torque on the gear train leading to the power reserve indicator hand, in order to eliminate this gear circumferential play.

Member 66 is formed of a barrel including a drum 68, a cover 70, an arbor 72 and a spring 74. It is fixed to a pivot-shank 76 secured to bottom-plate 10.

Drum 68 and cover 70 together form a housing in which spring 74 is located. This latter is connected, in a conventional manner, by one of its ends to arbor 72 and by the other to drum 68. It is arranged so that is wound and let down at the same time as motor spring 26.

Drum 68 is provided with a toothing 68*a* at its periphery, meshed with toothing 60*a* of wheel 60. Arbor 72 is rigidly mounted on pivot-shank 76, so that it cannot rotate.

In a variant which has not been shown, it would also be possible for toothing 68*a* to be meshed with indicator wheel 34 rather than with that of wheel 32. This is not, however, indispensable, since the circumferential play between pinion 58 of intermediate wheel 32 and wheel 34 is extremely small with respect to the circumferential play observed at differential gear 30.

With such a configuration, it should be noted that the torque generated by spring 74 must be less than the torque necessary for protuberance 64*a* to leave concave portion 62*a*. If this were not the case, it would result in a shift of the indicator corresponding to the relative movement of pinion 58 and wheel 60 via the effect of the torque of spring 74, which would be contrary to the desired objective.

Member 66, as described, exerts permanent torque on the gear train comprised between the two input wheels 42 and 44 of differential gear 30 and intermediate wheel 32.

The mechanism according to the invention is particularly well suited to manually wound watches, in particular to so-called 8 day watches, i.e. those in which the motor spring allows operating autonomy of more than a week. It is also applicable to automatic watches provided with a stopping system which blocks the winding of the motor spring when it is completely wound.

This mechanism may be subject to numerous variants without thereby departing from the scope of the invention. Thus, the differential gear could be plane rather than spherical. One could also envisage applying the mechanism to a watch movement including two barrels. In such case, the input wheels of the differential gear can be connected kinematically to the ratchet wheel of one of the barrels and to the drum of the other or of the same barrel.

What is claimed is:

1. A power reserve indicator mechanism for a timepiece movement of the type fitted with a power source formed of a motor spring (26), including a frame (10, 12, 14, 16), a power reserve indicator and a differential gear (30) with a first input (44) connected to a wheel (29) driven in rotation when the motor spring is wound, a second input (42) connected to a wheel (20) driven in rotation when the motor spring is let down, and an output (36*a*) connected to said indicator, wherein the indicator is capable of covering a given angle comprised between two end positions, the first of which is occupied when the motor spring is wound and the second, defined by a stop (78), when the motor spring is let down, wherein an intermediate wheel (32) is inserted between the output of the differential gear and said indicator and includes a resilient member (64) and two coaxial parts, one formed of a wheel (60), and the other of an arbor (58), one connected to said output (36*a*), the other to said indicator and connected to each other by said resilient member, said wheel being arranged so that the two parts rotate together while the indicator occupies a position comprised between said two end positions and wherein, at least when said indicator occupies its second end position, said gear continues to rotate freely while the indicator remains in abutment (against stopping means), and the resilient member is wound, while the motor spring drives the movement.

2. A mechanism according to claim 1, wherein the part connected to said gear is the wheel (60).

3. A mechanism according to claim 2, wherein the first resilient member includes a cam (62), secured in rotation to said arbor, and a spring (64) able to deform radially and rigidly fixed via one of its ends to said wheel (60), wherein the cam cooperates with the free end (64*a*) of said spring, the assembly arranged so that the free end of the spring slides on the cam when the indicator is in abutment and the motor spring continues to be let down and generate an opposite torque to that exerted by the motor spring.

4. A mechanism according to claim 1, further including a second resilient member (66) arranged to exert a permanent torque on the gear train comprised between the two input wheels (42,44) and the differential gear and the intermediate wheel (32).

5. A mechanism according to claim 4, wherein the second resilient member (66) includes an arbor (72) rigidly fixed to said frame (10), a drum (68) provided, at its periphery, with a toothing **(68*a*) which meshes with the part (60) of the wheel connected to said indicator, and a strip spring (74)** arranged in said drum and fixed, via one of its ends, to the arbor of the second resilient member and, via the other, to said drum.

6. A mechanism according to claim 4, wherein the second resilient member (66) is arranged so that it is wound and let down simultaneously with the motor spring (26).

7. A watch fitted with a mechanism according to claim 1, wherein its motor spring (26) assures a power reserve equal to at least 8 days.

8. A mechanism according to claim 2, further including a second resilient member (66) arranged to exert a permanent torque on the gear train comprised between the two input wheels (42,44) and the differential gear and the intermediate wheel (32).

9. A mechanism according to claim 3, further including a second resilient member (66) arranged to exert a permanent torque on the gear train comprised between the two input wheels (42,44) and the differential gear and the intermediate wheel (32).

10. A mechanism according to claim 5, wherein the second resilient member (66) is arranged so that it is wound and let down simultaneously with the motor spring (26).

11. A watch fitted with a mechanism according to claim 2, wherein its motor spring (26) assures a power reserve equal to at least 8 days.

12. A watch fitted with a mechanism according to claim 3, wherein its motor spring (26) assures a power reserve equal to at least 8 days.

13. A watch fitted with a mechanism according to claim 4, wherein its motor spring (26) assures a power reserve equal to at least 8 days.

14. A watch fitted with a mechanism according to claim 5, wherein its motor spring (26) assures a power reserve equal to at least 8 days.

15. A watch fitted with a mechanism according to claim 6, wherein its motor spring (26) assures a power reserve equal to at least 8 days.

* * * * *